US005462825A

United States Patent [19]

Tanaka et al.

[11] Patent Number: 5,462,825

[45] Date of Patent: Oct. 31, 1995

[54] ELECTROPHOTOGRAPHIC PHOTOCONDUCTOR HAVING A PHOTOSENSITIVE LAYER WITH CHARGE GENERATING PARTICLES AND A CHARGE TRANSPORTING MATERIAL DISPERSED IN A BINDER

[75] Inventors: Masashi Tanaka; Toshiyuki Fukami; Masato Katsukawa; Hideo Nakamori, all of Osaka, Japan

[73] Assignee: Mita Industrial Co., Ltd., Japan

[21] Appl. No.: 151,297

[22] Filed: Nov. 12, 1993

[30] Foreign Application Priority Data

Nov. 16, 1992 [JP] Japan ..... 4-305613

[51] Int. Cl.[6] ..... G03G 5/06

[52] U.S. Cl. ..... 430/58; 430/135

[58] Field of Search ..... 430/58, 83, 135

[56] References Cited

U.S. PATENT DOCUMENTS

| | | | |
|---|---|---|---|
| 3,121,006 | 2/1964 | Middleton et al. | 96/1 |
| 3,460,963 | 8/1969 | Bonjour | 117/34 |
| 5,288,574 | 2/1994 | Desilets et al. | 430/58 |
| 5,308,727 | 5/1994 | Osawa et al. | 430/58 |

FOREIGN PATENT DOCUMENTS

| | | |
|---|---|---|
| 1497236 | 5/1969 | Germany . |
| 2214981 | 10/1972 | Germany . |
| 1169454 | 7/1989 | Japan . |
| 2153357 | 6/1990 | Japan . |
| 1365837 | 9/1974 | United Kingdom . |

OTHER PUBLICATIONS

Decker et al, IS+T Final Program and Proceedings, vol. 1, pp. 328–335, Oct. 6, 1991, "High Gamma OPC for High Speed LED Printer".

*Primary Examiner*—John Goodrow
*Attorney, Agent, or Firm*—Renner, Otto, Boisselle & Sklar

[57] ABSTRACT

An electrophotographic photoconductor includes: a conductive substrate and a photosensitive layer formed on the conductive substrate, wherein the photosensitive layer includes charge generating particles, a charge transporting material, and a binder resin, and the charge generating particles are made of a composition including a charge generating material dispersed in a binding medium.

7 Claims, 2 Drawing Sheets

ELECTROPHOTOGRAPHIC PHOTOCONDUCTOR HAVING A PHOTOSENSITIVE LAYER WITH CHARGE GENERATING PARTICLES AND A CHARGE TRANSPORTING MATERIAL DISPERSED IN A BINDER

BACKGROUND OF THE INVENTION

1. Field of the Invention

The present invention relates to an electrophotographic photoconductor used for image forming apparatuses such as an electrophotographic printer, a PPF, and a digital copier.

2. Description of the Related Art

Conventionally, a positively chargeable electrophotographic photoconductor has been demanded, because of its stable discharge and reduced ozone generation during a corona discharge. There are two types of electrophotographic photoconductors, i.e., a multi-layer photoconductor and a single-layer photoconductor.

A multi-layer positively chargeable electrophotographic photoconductor includes a charge generating layer containing a charge generating material and a charge transporting layer containing a charge transporting material. In a conventional multi-layer negatively chargeable electrophotographic photoconductor, the charge transporting layer is formed on the charge generating layer, while in the multi-layer positively chargeable electrophotographic photoconductor, the charge generating layer is formed on the charge transporting layer, since the charge transporting material is mainly a hole transporting material. However, the multi-layer positively chargeable electrophotographic photoconductor is difficult to produce and has not been put to practical use due to the following problems: When the charge generating layer is coated onto the charge transporting layer, the charge transporting material is eluted into the charge generating layer; and the charge generating material is scraped off from the charge generating layer due to the abrasion caused by the repetition of copying. In addition, the multi-layer electrophotographic photoconductor essentially has a drawback that a high γ characteristic cannot be obtained.

On the other hand, the single-layer positively chargeable electrophotographic photoconductor has been extensively developed, since it can be more easily produced than the above-mentioned multi-layer positive chargeable electrophotographic photoconductor.

An example of the single-layer positively chargeable electrophotographic photoconductor is disclosed in Japanese Laid-Open Patent Publication No. 1-169454. This electrophotographic photoconductor has a feature in that the photoconductor uses phthalocyanine as a photoconductive material, but does not use the charge transporting material. Because of this feature, such a single-layer positively chargeable electrophotographic photoconductor (hereinafter referred to as a single-layer electrophotographic photoconductor A) has a high γ characteristic and is suitable for a printer, drawing much attention in recent years.

However, the single-layer electrophotographic photoconductor A has the following problems: Since the single-layer electrophotographic photoconductor A does not use the charge transporting material, the sensitivity thereof is lower than that of the functionally divided multi-layer electrophotographic photoconductor using both the charge generating material and the charge transporting material. Moreover, the charge generating material such as phthalocyanine is likely to adsorb gas; therefore, the chargeability of the single-layer electrophotographic photoconductor A is decreased by the influence of active gas such as ozone and nitrogen oxides.

Here, the γ characteristic which is important for the electrophotographic photoconductor will be described.

In order to obtain satisfactory reproduction and resolution of a minute image such as a letter, a developing method having high development sensitivity (i.e., a high γ value). The term "γ", as being used in the present specification, has its origins in silver photography. In the silver photography, γ is represented by the formula: $\gamma = dD/dLogE$, where D is an exposure density, and E is an exposure amount. That is, the γ characteristic is the measure of image contrast at different levels of exposure.

In electrophotography, the photoconductor plays a role similar to a film in silver photography. In the electrophotographic process, the voltage at a given point on the surface of an electrophotographic photoconductor which has been uniformly charged will be determined by the amount of light energy that the point has been exposed to. During the development step, this voltage level on the surface of the photoconductor will determine the density of that point on the printed output. The γ characteristic of the electrophotographic photoconductor is defined as the absolute value of a slope of the characteristic curve obtained by plotting the relationship between a surface potential and an exposure energy (the surface potential is plotted on the ordinate and the exposure energy is plotted on the abscissa). This slope is varied depending on the structure and properties of a photosensitive layer. A high γ characteristic according to the present invention corresponds to a large absolute value for the slope of the characteristic curve, where the electrophotographic photoconductor does not respond to small exposure energy of incident light, maintains the surface potential and rapidly responds to exposure energy which has reached a certain degree. In the case where the surface potential is rapidly decreased in a narrow range of exposure energy, the γ characteristic is considered to be high. As the γ characteristic is higher, a minute image can be more clearly reproduced and the resolution thereof is more excellent.

Sensitivity is referred to as a surface potential value at which the surface potential becomes stable at a time when the exposure energy is increased to a certain degree.

Referring to FIG. 1, the features of the multi-layer electrophotographic photoconductor and the single-layer electrophotographic photoconductor A will be described.

FIG. 1 is a graph showing the relationship between the exposure energy (E) and the surface potential (V) in the multi-layer electrophotographic photoconductor and the single-layer electrophotographic photoconductor A.

In this graph, a curve 1 represents an exposure energy (E)-surface potential (V) curve (hereinafter, referred to as an EV characteristic curve) of the single-layer electrophotographic photoconductor A, and a curve 2 represents an EV characteristic curve of the multi-layer electrophotographic photoconductor. As shown in FIG. 1, the sensitivity of the multi-layer electrophotographic photoconductor is high, but the γ characteristic thereof is not high. On the other hand, the γ characteristic of the single-layer electrophotographic photoconductor A is high, but the sensitivity thereof is low.

In order to overcome the above-mentioned problems, the inventors studied a single-layer positively chargeable electrophotographic photoconductor (hereinafter referred to as a single-layer electrophotographic photoconductor B) in which a charge generating material and a charge transporting material are uniformly dispersed in a photosensitive layer, by varying the content of these materials. As a result of the study, the sensitivity of the electrophotographic photoconductor has improved, however, the electrophotographic photoconductor lacks the ability of retaining an electrical potential without responding in the case where the exposure energy is small. Thus, an electrophotographic photoconductor having sufficiently high γ characteristic has not been obtained. The reasons for this have not been made clear. It can be considered that a so-called avalanche phenomenon (described later) is not obtained in the case where the charge generating material and the charge transporting material are dispersed in the photosensitive layer.

SUMMARY OF THE INVENTION

The electrophotographic photoconductor of the present invention, includes:

a conductive substrate and a photosensitive layer formed on the conductive substrate, wherein the photosensitive layer includes charge generating particles, a charge transporting material, and a binder resin, and the charge generating particles are made of a composition including a charge generating material dispersed in a binding medium.

In one embodiment of the present invention, the charge generating particles are included in the photosensitive layer in an amount of 1 to 30 parts by weight per 100 parts by weight of the binder resin.

In another embodiment of the present invention, the charge generating material is included in the charge generating particles in an amount of 10 to 95 parts by weight per 100 parts by weight of the binding medium.

In still another embodiment of the present invention, the charge generating material is phthalocyanine.

In still another embodiment of the present invention, the charge transporting material is included in the photosensitive layer in an amount of 2 to 200 parts by weight per 100 parts by weight of the binder resin.

According to another aspect of the present invention, the electrophotographic photoconductor includes a conductive substrate and a photosensitive layer formed on the conductive substrate, the photosensitive layer including a charge generating material, a charge transporting material and a binder resin, wherein an exposure energy (E)-surface potential (V) curve of the electrophotographic photoconductor has a point of inflection.

In one embodiment of the present invention, the point of inflection is present on the exposure energy (E)-surface potential (V) curve in the range of 0.3 to 3 $\mu J/cm^2$ of the exposure energy (E).

Thus, the invention described herein makes possible the advantages of (1) providing an electrophotographic photoconductor having high sensitivity and resolution, and high γ characteristic irrespective of the presence of a charge transporting material; and (2) providing an electrophotographic photoconductor suitably used for image forming apparatuses such as an electrophotographic printer, a PPF, and a digital copier.

These and other advantages of the present invention will become apparent to those skilled in the art upon reading and understanding the following detailed description with reference to the accompanying figures.

DESCRIPTION OF THE PREFERRED EMBODIMENTS

An electrophotographic photoconductor of the present invention includes a conductive substrate and a photosensitive layer formed on the conductive substrate. The photosensitive layer contains charge generating particles, a charge transporting material and a binder resin. Each of the charge generating particle is made of a composition containing a charge generating material dispersed in a binding medium. The charge generating particles are dispersed in the photosensitive layer.

Hereinafter, the operation of the electrophotographic photoconductor of the present invention will be described.

Figure 1:
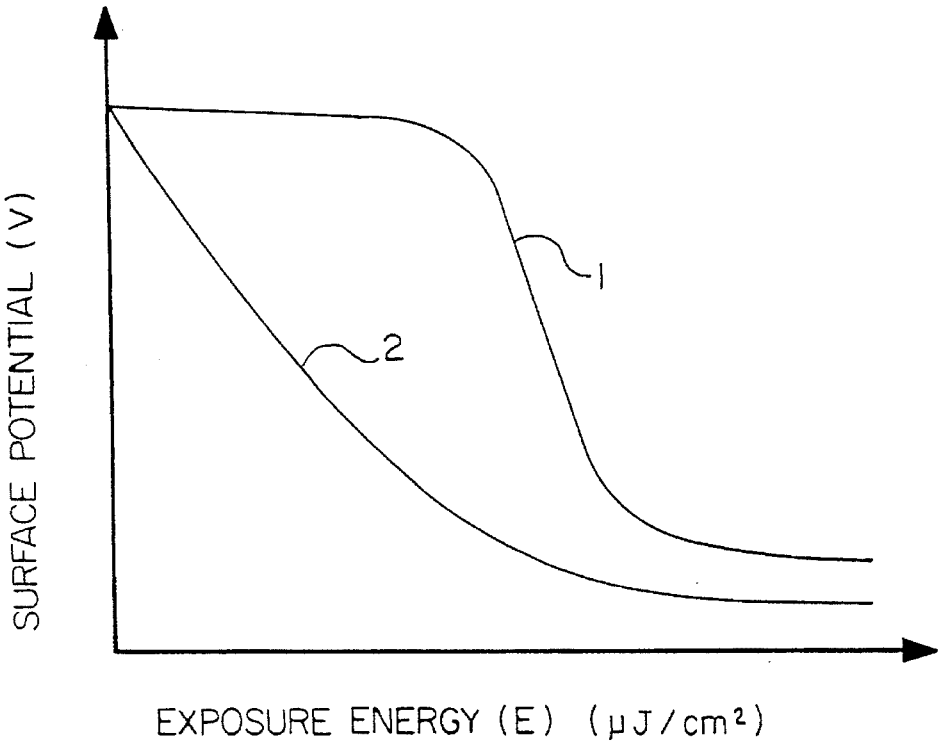
FIG. 1 is a graph showing the relationship between the exposure energy (E) and the surface potential (V) in a conventional multi-layer electrophotographic photoconductor and a single-layer electrophotographic photoconductor A.
Figure 2:
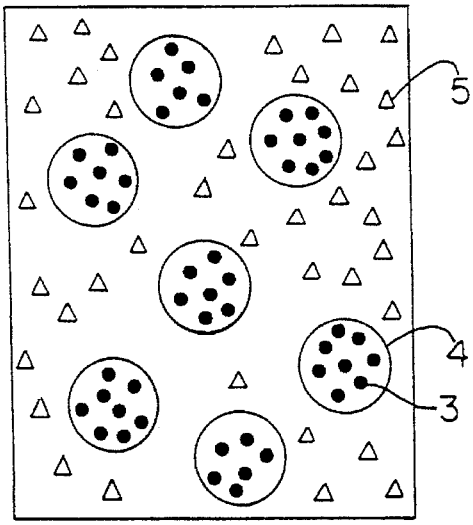
FIG. 2 is a view schematically showing the inside of a photosensitive layer of an electrophotographic photoconductor according to the present invention.

FIG. 2 is a view schematically showing the inside of the photosensitive layer of the electrophotographic photoconductor of the present invention. In FIG. 2, the reference numeral 3 denotes a charge generating material, 4 charge generating particles made of a composition containing the charge generating material dispersed in a binding medium, and 5 a charge transporting material.

Figure 3:
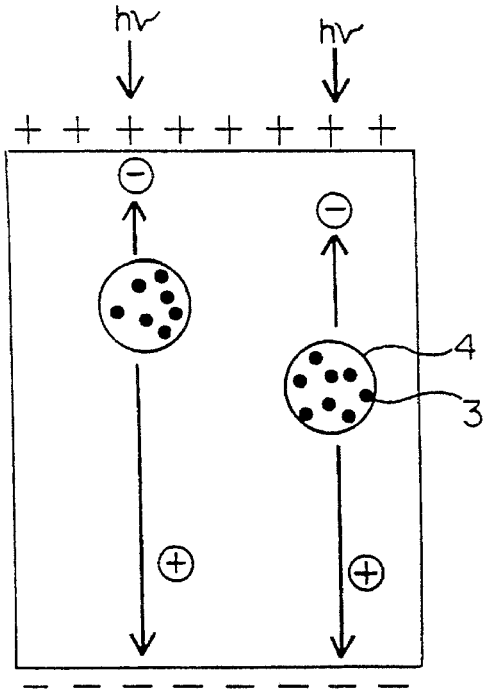
FIG. 3 is a view schematically showing the state of a charge movement in the photosensitive layer in the case where light is irradiated to the electrophotographic photoconductor whose surface is uniformly and positively charged.

FIG. 3 is a view schematically showing the state of a charge movement in the photosensitive layer in the case where light is irradiated to the electrophotographic photoconductor whose surface is uniformly and positively charged. In FIG. 3, the same reference numerals as those in FIG. 2 denote the same components as those in FIG. 2. The surface of the photosensitive layer is uniformly and positively charged due to a corona discharge. When light is irradiated to the surface of the photosensitive layer in accordance with an image pattern, a charge (i.e., electrons (−) and holes (+)) is generated from each charge generating particle 4. In the charge generating particle 4, the charge generating material 3 is dispersed in the binding medium, so that the charge generating particle 4 is capable of storing the charge. When the charge is stored in the charge generating particle 4 the electric field is raised. Therefore, electrons generated from the charge generating particle 4 are put under a strong electric field from the photosensitive layer. As a result, the electrons are accelerated at a high speed and bump against other charge generating particles 4 without bumping against phonons.

That is, according to the present invention, the charge generating particle 4 stores the charge. When the electric field in the photosensitive layer becomes strong, a plurality of electrons are rapidly released from the charge generating particle 4 and bump against other charge generating particles 4 to cause an avalanche phenomenon. Once the avalanche phenomenon occurs, the electrons are transported, in a group, up to the surface of the photosensitive layer. It is considered that the high γ characteristic is obtained as a result of this movement of the electrons.

In order to obtain such a characteristic, it is required that the charge generating material 3 is present in the photosensitive layer as a collective, not as primary particles. According to the present invention, since the charge generating material 3 is dispersed in each charge generating particle 4 with no charge transporting material 5 in the charge generating particle 4, the charge generating material 3 is present in the charge generating particle 4 as primary particles in an insulating state. In the strong electric field of the photosensitive layer caused by the charge storage in each charge generating particle 4, the electrons are released from the charge generating particle 4, being transported, in a group up to the surface of the charge generating particle 4 and bumping against other charge generating particles 4 due to the tunneling effect. The electrons which bump against other charge generating particles 4 cause the avalanche phenomenon, resulting in successively increased electrons. These electrons are rapidly injected into the charge transporting material 5 present in the photosensitive layer and finally, but rapidly, reach the surface of the photosensitive layer.

On the other hand, in the case of the conventional single-layer electrophotographic photoconductor B in which the charge generating material and the charge transporting material are uniformly dispersed in the photosensitive layer, i.e., in the case where the charge generating material is dispersed as primary particles in the photosensitive layer, generated electrons are effectively transported to the neighboring charge transporting material. In this way, the single-layer electrophotographic photoconductor B responds to even small exposure energy, so that the charge is not stored, causing no avalanche phenomenon.

According to the present invention, it is not required that the charge be transported among the charge generating material. Therefore, the content of the charge generating material in the photosensitive layer is less than that in the conventional single-layer electrophotographic photoconductor A. Thus, the electrophotographic photoconductor of the present invention has high stability with respect to an active gas such as ozone. In addition, according to the present invention, the avalanche phenomenon occurs even though the charge transporting material is contained in the photosensitive layer, and the generated electrons are transported in a group at a high speed via the charge transporting material, so that the sensitivity of the electrophotographic photoconductor becomes high.

According to the present invention, an electrophotographic photoconductor includes a conductive substrate and a photosensitive layer formed on the conductive substrate. The photosensitive layer includes a charge generating material, a charge transporting material and a binder resin. In this case, the EV characteristic curve of the electrophotographic photoconductor has a point of inflection. Such a photoconductor hardly responds to small exposure energy of incident light and rapidly responds to exposure energy which has reached a certain degree. Because of this characteristic of the photoconductor, the EV characteristic curve has a point of inflection. The electrophotographic photoconductor including the charge transporting material and the charge generating material, as well as having this characteristic has not been known. The electrophotographic photoconductor of the present invention includes a charge transporting material and a charge generating material, and the EV characteristic curve thereof has a point of inflection. According to the present invention, an electrophotographic photoconductor having this characteristic can be realized in both a single-layer type and a multi-layer type. It is preferred that the exposure energy (E) is present in a narrow range of 0.3 $\mu J/cm^2$ to 3 $\mu J/cm^2$, considering the high $\gamma$ characteristic and the sensitivity of the photoconductor. Such a photoconductor can be obtained by forming the photosensitive layer including the charge generating particles and the charge transporting material on the conductive substrate. The point of inflection corresponds to a point where a derivative function of the second order becomes O. The point of inflection can be presumed based on the change of sign for the function, since the sign of the function changes before and after the point of inflection.

Hereinafter, materials used for the electrophotographic photoconductor of the present invention and a method for producing the same will be described.

CHARGE GENERATING PARTICLES

The charge generating particle used for the present invention is a composition including a binding medium and a charge generating material. In general, the charge generating material is uniformly dispersed in the binding medium.

The charge generating particle is prepared by a general method for producing a particle. For example, the charge generating particle can be prepared by a method for producing an electrostatic latent image developing toner. The charge generating particle can be prepared by a kneading and grinding method as follows: A charge generating material and a binding medium are mixed together; the mixture thus obtained is melt-kneaded to obtain a kneaded substance by using an extruder, a roll mill, a kneader, etc., in which the charge generating material is uniformly dispersed in the binding medium; and the kneaded substance is ground by a hammer mill, a jet mill, etc, thereby obtaining the charge generating particle. Alternatively, the charge generating particle can be prepared by a spray dry method as follows: A charge generating material and a binding medium are mixed and dispersed in a solvent so as to be a solution or a slurry; the resulting solution or slurry is spray-dried to form minute particles. Alternatively, the charge generating particle can be obtained by known methods such as polymerization including suspension polymerization and emulsion polymerization, and coacervation. The emulsion polymerization is effected by stirring the charge generating material together with a monomer, a cross-linking agent, an initiator, viscous oil, and a dispersant at a high speed and an appropriate temperature. If required, a dispersing assistant can be added. The particle size of the charge generating particles obtained by these methods can be adjusted by classification.

As the charge generating material, organic pigments and coloring matter particles can be used. Examples of the organic pigments include azo organic pigments, phthalocyanine organic pigments, condensed polycyclic organic pigments, quinone coloring matters, etc. In particular, the phthalocyanine organic pigments are preferably used. As the phthalocyanine organic pigments, titanyl phthalocyanine, metal-free phthalocyanine, and copper phthalocyanine are preferably used.

Examples of the binding medium include thermoplastic resins such as styrene monomers, styrenic polymers, styrene-butadiene copolymers, styrene-acrylonitrile copolymers, styrene-maleic acid copolymers, acrylic copolymers, styrene-acrylic copolymers, polyethylene, ethylene-vinyl acetate copolymer, chlorinated polyethylene, polyvinyl chloride, polypropylene, vinyl chloride-vinyl acetate copolymer, polyester, alkyd resin, polyamide, polyurethane, polycarbonate, polyarylate, polysulfone, diallyl phthalate resin, ketone resin, polyvinyl butyral resin, and polyether resin; crosslinkable thermosetting resins such as silicone resin, epoxy resin, and the like; and photo-setting resins such as epoxy acrylate, urethane-acrylate, etc. These binding mediums can be used alone or in combination of two or more kinds thereof. It is preferred that a resin of the binding medium used for the charge generating particle is different from that used for the photosensitive layer described later. The reason for this is to prevent the charge transporting material dispersed in the photosensitive layer from mixing in the charge generating particle. In the case where the same kind of resins are used for the charge generating particle and for the charge transporting material, it is required that the resin used for the charge generating particle is cross-linked to be a curable resin. In either case, in order to prevent the charge transporting material dispersed in the photosensitive layer from mixing in the charge generating particle, it is preferred that the resin used for the charge generating particle is a thermosetting resin or is encapsulated.

The content of the charge generating material in the charge generating particle is preferably in the range of 10 to 95 parts by weight per 100 parts by weight of the binding medium in the charge generating particle. When the content of the charge generating material is less than 10 parts by weight, the sensitivity of the resulting photoconductor is poor. When the content of the charge generating material is more than 95 parts by weight, the high $\gamma$ characteristic is decreased.

The particle size of the charge generating particle is varied depending upon its combination with the binder resin (described later). In general, the particle size is about 0.1 to several μm. It is preferred that the particle size of the charge generating particle is less than 3 μm. However, when the particle size is too small, a $\gamma$ characteristic as low as that of the photoconductor in which the charge generating material is uniformly dispersed in the photosensitive layer is obtained. Thus, too small a particle size is not preferred.

The charge generating particles are dispersed in the photosensitive layer in an amount of 1 to 30 parts by weight, preferably 1 to 20 parts by weight per 100 parts by weight of the binder resin. When the content of the charge generating particles is less than 1 part by weight, the sensitivity of the resulting photoconductor is poor. When the content of the charge generating particles is more than 30 parts by weight, black attenuation is increased, resulting in the decreased charge characteristics of the charge generating particles. The reason for this is that the charge generating material becomes unstable due to the active gas. Thus, the content out of the above-mentioned range is not preferred.

BINDER RESIN

The binder resin used for the photosensitive layer is selected from the resins similar to those used for the charge generating particles. As described above, it is preferred that, as the binder resin, a different kind of resin from that of the resin used for the charge generating particle is used. These resins for the binder resin can be used alone or in combination of two or more kinds thereof.

CHARGE TRANSPORTING MATERIAL

Examples of the charge transporting material include benzidine compounds such as N,N'-bis(o,p-dimethylphenyl)-N,N'-diphenylbenzidine; diphenoquinone compounds such as 3,5-dimethyl-3',5'-di-ter-butyldiphenoquinone; oxadiazole compounds such as 2,5-di(4-methylaminophenyl)-1,3,4-oxadiazole; styrylic compounds such as 9-(4-diethylaminostyryl)anthracene; carbazole compounds such as polyvinylcarbazole; pyrazoline compounds such as 1-phenyl-3-(p-dimethylaminophenyl)pyrazoline; nitrogen-containing cyclic compounds and condensed polycyclic compounds such as triphenylamine compounds, indole compounds, oxazole compounds, isooxazole compounds, thiazole compounds, thiadiazole compounds, imidazole compounds, pyrazole compounds, and triazole compounds, etc. In the case where the charge transporting material having a film-forming property such as polyvinylcarbazole is used, the binder resin is not always required.

The charge transporting material can be contained in the photosensitive layer in an amount of 2 to 200 parts by weight, preferably 20 to 120 parts by weight per 100 parts by weight of the binder resin.

CONDUCTIVE SUBSTRATE

As the conductive substrate, various materials having conductivity can be used. Examples include a simple substance of a metal such as aluminum, copper, tin, platinum, silver, vanadium, molybdenum, chromium, cadmium, titanium, nickel, palladium, indium, stainless steel, or brass, or a sheet thereof; plastic members vacuum evaporated or laminated with these metals thereon; a plastic sheet or glass members coated with aluminum iodide, tin oxide, or indium oxide thereon.

Any of these conductive substrates can be any shape, such as a sheet-like shape, a drum-like shape, etc. It is desired for the substrate to be conductive by itself or to have a conductive surface and to have a mechanical strength to be sufficiently durable upon use.

SENSITIZER AND OTHER ADDITIVES

In order to improve the dispersion and coating of the charge transporting material and the charge generating particles, a surfactant, a leveling agent or the like can be contained in the photosensitive layer.

FILM FORMATION

The electrophotographic photoconductor of the present invention can be obtained by forming the photosensitive layer on the conductive substrate. The photosensitive layer is generally formed by a coating process, however, the method is not particularly limited thereto. In the case of using a coating, the photosensitive layer is formed, for example, as follows: Charge generating particles, a charge transporting material, a binder resin, and a solvent are mixed by means of a roll mill, a ball mill, an attritor, a paint shaker, or an ultrasonic dispersing device; and the mixed solution thus obtained is coated on to the conductive substrate, followed by drying. Examples of the solvent used for forming the photosensitive layer include alcohols such as methanol, ethanol, isopropanol, butanol, etc.; aliphatic hydrocarbons such as n-hexane, octane, cyclohexane, etc.; aromatic hydrocarbons such as benzene, toluene, xylene, etc.; halogenated hydrocarbons such as dichloromethane, dichloroethane, carbon tetrachloride, chlorobenzene, etc.; ethers such as dimethyl ether, diethyl ether, tetrahydrofuran, ethylene glycol dimethyl ether, diethylene glycol dimethyl ether, etc.; ketones such as acetone, methyl ethyl ketone, cyclohexanone, etc.; esters such as ethyl acetate, methyl acetate, etc.; dimethylformaldehyde; dimethylformamide; dimethylsulfoxide, etc.

These solvents can be used alone or in combination with two or more kinds thereof. It is required that these solvents do not dissolve the charge generating particles and the binding medium contained in the charge generating particles.

It is noted that the materials and method for producing the electrophotographic photoconductors are not limited to those described above.

Hereinafter, the present invention will be described by way of illustrative examples.

EXAMPLE 1

Preparation of Charge Generating Particles

First, a solution of 100 ml of ion exchange water, 0.6% by weight of dispersant (dissolution-retardant phosphoric compound) based on the total weight of the ion exchange water, and 30 ppm of dispersing assistant (sodium dodecylbenzene sulfonate) were mixed with 5 g of styrene monomer, 15 g of cross-linking agent (trimethylolpropane trimethacrylate), 14.5% by weight of initiator (benzoyl peroxide) based on the total weight of the styrene monomer, 15 g of viscous oil (linseed oil), and 5 g of charge generating material (metal-free phthalocyanine), and stirred at a high speed of 800 rpm for 5 hours to obtain an oil-in-water type dispersion. Then, the dispersion thus obtained was polymerized at 70° C. for 5 hours to obtain charge generating particles containing metal-free phthalocyanine. The charge generating particles were washed with water, followed by drying. This step was repeated. Coarse particles were removed from the charge generating particles by classification, whereby charge generating particles having a particle size of 2 μm were obtained.

Production of Single-layer Electrophotographic Photoconductor

First, 1 part by weight of charge generating particles obtained as described above, 10 parts by weight of polycarbonate resin, and a charge transporting material (i.e., 6 parts by weight of N,N'-bis(o,p-dimethylphenyl)-N,N'-diphenylbenzidine and 4 parts by weight of 3,5-dimethyl-3',5'-di-tert-butyldiphenoquinone) were dispersed in benzene. Then, the dispersion solution thus obtained was coated on to an aluminum drum by dip coating and then dried by heating at 100° C. for 2 hours to form a photosensitive layer having a thickness of 20 μm thereon. Thus, a single-layer electrophotographic photoconductor was obtained.

EXAMPLE 2

A single-layer electrophotographic photoconductor was obtained in the same way as in Example 1, except that oxotitanyl phthalocyanine was used instead of metal-free phthalocyanine in the preparation of the charge generating particles.

EXAMPLE 3

A single-layer electrophotographic photoconductor was obtained in the same way as in Example 1, except that copper phthalocyanine was used instead of metal-free phthalocyanine in the preparation of the charge generating particles.

COMPARATIVE EXAMPLE 1

In this comparative example, an electrophotographic photoconductor which does not include a charge transporting material but does include only a charge generating material was obtained.

First, 10 g of metal-free phthalocyanine, 25 g of polyester resin, 6 g of melamine resin, and 210 g of cyclohexanone were dispersed by a ball mill for 24 hours. The dispersion solution thus obtained was coated on to an aluminum drum and then dried by heating at 150° C. for 60 minutes to form a photosensitive layer having a thickness of 15 μm. Thus, a single-layer electrophotographic photoconductor was obtained.

COMPARATIVE EXAMPLE 2

In this comparative example, an electrophotographic photoconductor in which a charge generating material and a charge transporting material are dispersed in a photosensitive layer was obtained.

A single-layer electrophotographic photoconductor was obtained in the same way as in Example 1, except that 3 parts by weight of metal-free phthalocyanine instead of the charge generating particle, 100 parts by weight of polycarbonate resin, and the charge transporting material (i.e., 60 parts by weight of N,N'-bis(o,p-dimethylphenyl)-N,N'-diphenylbenzidine and 40 parts by weight of 3,5-dimethyl-3',5'-di-tert-butyldiphenoquinone) were used.

EVALUATION TEST I

The electrophotographic photoconductors obtained in Example 1 and Comparative Examples 1 and 2 were placed in an electrostatic copying test apparatus (Gentec Sincere 30M, manufactured by Gentec Corporation). The surface of each photoconductor was positively charged. A current flowing into each electrophotographic photoconductor was varied to set an initial surface potential at 700 V.

Figure 4:
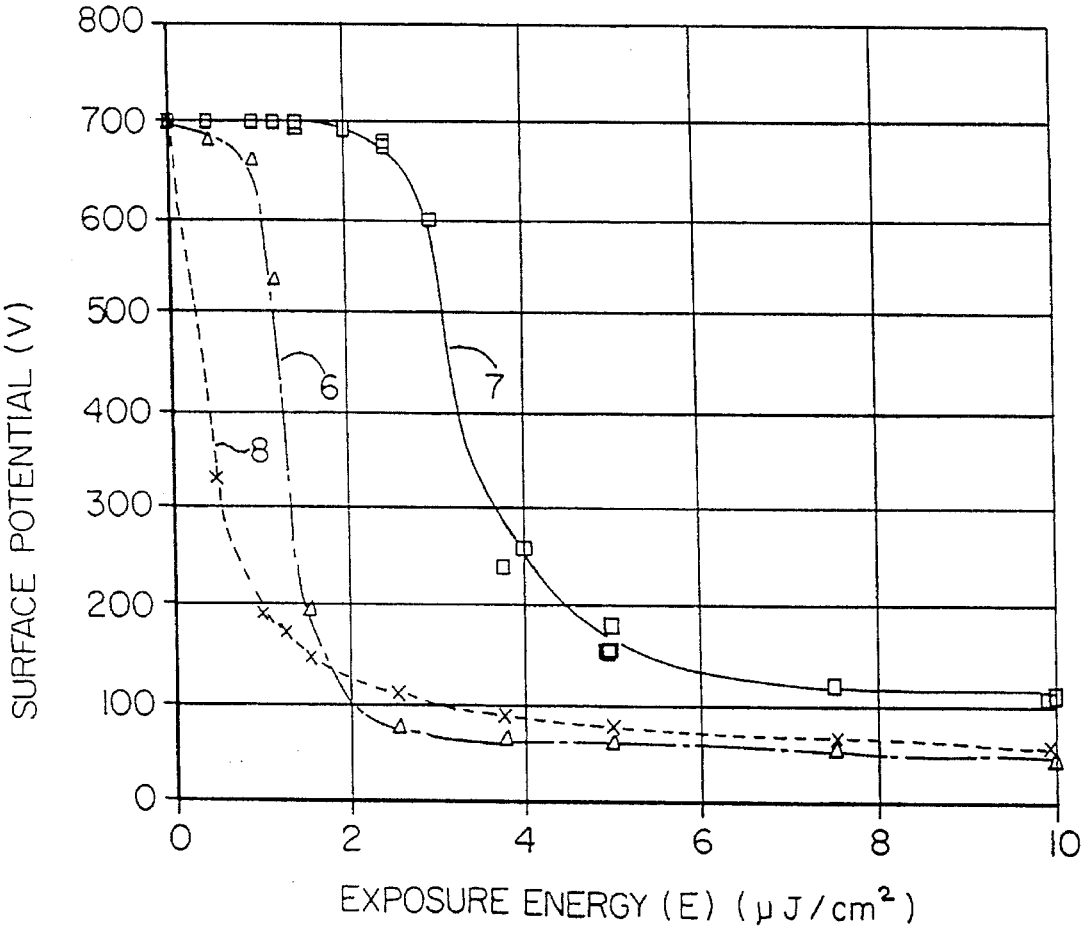
FIG. 4 is a graph showing the relationship between the exposure energy (E) and the surface potential (V) in electrophotographic photoconductors obtained according to Examples of the present invention and Comparative Examples.

Then, the surface potential (V) of each electrophotographic photoconductor was measured by varying the exposure energy ($\mu J/cm^2$). FIG. 4 shows the relationship between the exposure energy and the surface potential in each electrophotographic photoconductor. In this figure, curve 6 represents an EV characteristic curve of the electrophotographic photoconductor obtained in Example 1, curve 7 an EV characteristic curve of the electrophotographic photoconductor obtained in Comparative Example 1, and curve 8 an EV characteristic curve of the electrophotographic photoconductor obtained in Comparative Example 2. Curve 6 has a point of inflection at about 1.3 $\mu J/cm^2$.

As is understood from FIG. 4, the electrophotographic photoconductor obtained in Example 1 has a higher $\gamma$ characteristic than either of the electrophotographic photoconductors obtained in Comparative Examples 1 and 2. Also, the electrophotographic photoconductor obtained in Example 1 has more excellent sensitivity than either of the electrophotographic photoconductors obtained in Comparative Examples 1 and 2.

EVALUATION TEST II

The electrophotographic photoconductors obtained in Examples 1, 2, and 3 and Comparative Examples 1 and 2 were placed in an electrostatic copying test apparatus (Gentec Sincere 30M, manufactured by Gentec Corporation). The surface of each photoconductor was positively charged. A current flowing into each electrophotographic photoconductor was varied to set an initial surface potential at 700 V.

Then, the surface potential (V) of each electrophotographic photoconductor was measured by varying the exposure energy in the range of 0 to 10 μJ/cm$^2$. EV characteristic curves of each electrophotographic photoconductor were formed. Points on the EV characteristic curves, where the derivative functions of the second order become 0 were obtained by calculation as points of inflection. Also, the surface potentials of each electrophotographic photoconductor at an exposure energy of 10 μJ/cm$^2$ were obtained as sensitivity (V). The results are shown in Table 1.

TABLE 1

| | Point of inflection (μJ/cm$^2$) | Sensitivity (V) |
|---|---|---|
| Example 1 | 1.3 | 40 |
| Example 2 | 1.2 | 25 |
| Example 3 | 1.5 | 45 |
| Comparative Example 1 | 3.3 | 120 |
| Comparative Example 2 | — | 50 |

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An electrophotographic photoconductor comprising:

a conductive substrate and a photosensitive layer formed on the conductive substrate, wherein the photosensitive layer comprises charge generating particles, a charge transporting material, and a binder resin, and the charge generating particles are made of a composition comprising an organic charge generating material dispersed in a binding medium, and wherein the charge generating particles are comprised in the photosensitive layer in an amount of 1 to 30 parts by weight per 100 parts by weight of the binder resin.

2. The electrophotographic photoconductor according to claim 1, wherein the charge generating particles are comprised in the photosensitive layer in an amount of 1 to 20 parts by weight per 100 parts by weight of the binder resin.

3. The electrophotographic photoconductor according to claim 1, wherein the charge generating material is comprised in the charge generating particles in an amount of 10 to 95 parts by weight per 100 parts by weight of the binding medium.

4. The electrophotographic photoconductor according to claim 1, wherein the charge generating material is phthalocyanine.

5. The electrophotographic photoconductor according to claim 1, wherein the charge transporting material is comprised in the photosensitive layer in an amount of 2 to 200 parts by weight per 100 parts by weight of the binder resin.

6. An electrophotographic photoconductor comprising a conductive substrate and a photosensitive layer formed on the conductive substrate, the photosensitive layer comprising a charge generating material, a charge transporting material and a binder resin, wherein an exposure energy (E)-surface potential (V) curve of the electrophotographic photoconductor has a point of inflection.

7. The electrophotographic photoconductor according to claim 6, wherein the point of inflection is present on the exposure energy (E)-surface potential (V) curve in the range of 0.3 to 3 μJ/cm$^2$ of the exposure energy (E).

* * * * *